US006842921B1

(12) United States Patent
Tsiarkezos et al.

(10) Patent No.: US 6,842,921 B1
(45) Date of Patent: Jan. 18, 2005

(54) SLIP RESISTANT FITTED COVER

(75) Inventors: Stephen H. Tsiarkezos, Elkton, MD (US); Dimitri P. Zafiroglu, Centreville, DE (US)

(73) Assignee: Xymid, L.L.C., Chesterfield, VA (US)

( * ) Notice: Subject to any disclaimer, the term of this patent is extended or adjusted under 35 U.S.C. 154(b) by 0 days.

(21) Appl. No.: 10/716,237

(22) Filed: Nov. 18, 2003

(51) Int. Cl.[7] ..... A14G 9/02
(52) U.S. Cl. ..... 5/497; 5/499
(58) Field of Search ..... 5/497, 498, 499, 5/495, 482

(56) References Cited

U.S. PATENT DOCUMENTS

| | | | | | |
|---|---|---|---|---|---|
| 2,942,280 | A | * | 6/1960 | May, Jr. | 5/497 |
| 3,020,566 | A | * | 2/1962 | Anderson et al. | 5/497 |
| 3,857,124 | A | * | 12/1974 | Hadley | 5/496 |
| 4,962,546 | A | * | 10/1990 | Vitale | 5/497 |
| 4,985,953 | A | * | 1/1991 | Seago | 5/497 |
| 5,020,177 | A | * | 6/1991 | Etherington | 5/496 |
| 5,046,207 | A | * | 9/1991 | Chamberlain | 5/496 |
| 5,056,441 | A | * | 10/1991 | Seago | 112/2.1 |
| 5,127,115 | A | | 7/1992 | Williams et al. | 5/497 |
| 5,187,952 | A | | 2/1993 | Zafiroglu | 66/192 |
| 5,247,893 | A | * | 9/1993 | Zafiroglu | 112/475.08 |
| 5,249,322 | A | * | 10/1993 | Seago | 5/499 |
| 5,325,555 | A | * | 7/1994 | Whitley | 5/500 |
| 5,479,664 | A | * | 1/1996 | Hollander | 5/499 |
| 5,530,979 | A | * | 7/1996 | Whitley | 5/500 |
| 5,603,132 | A | | 2/1997 | Zafiroglu | 5/497 |
| 5,625,912 | A | * | 5/1997 | McCain et al. | 5/497 |
| 5,636,393 | A | | 6/1997 | Zafiroglu et al. | 5/499 |
| 5,996,148 | A | * | 12/1999 | McCain et al. | 5/497 |
| 6,199,231 | B1 | | 3/2001 | Zafiroglu | 5/497 |
| 6,272,701 | B1 | | 8/2001 | Zafiroglu | 5/499 |
| 6,353,947 | B1 | * | 3/2002 | McCain et al. | 5/500 |
| 6,499,157 | B1 | * | 12/2002 | McCain et al. | 5/497 |
| 2002/0088054 | A1 | * | 7/2002 | McCain et al. | 5/500 |

* cited by examiner

*Primary Examiner*—Robert G. Santos
(74) *Attorney, Agent, or Firm*—Jeffrey C. Lew

(57) ABSTRACT

A slip resistant cover for various articles has a central, substantially non-stretchable sheet and a border of a cross-extensible strip around the perimeter of the sheet. The strip can extend incrementally from its relaxed state by at least 150% under tension of 160 g/cm of strip width or less. Preferably the strip has an open mesh net structure. The slip resistant cover is suitable for covering diverse items, including bedding materials, vehicles, equipment, furniture and the like.

21 Claims, 5 Drawing Sheets

SLIP RESISTANT FITTED COVER

FIELD OF THE INVENTION

This invention relates to fitted covers of textile and other fabrics used to cover various articles such as vehicles, equipment, household items, apparel items and the like. More specifically, the invention relates to fitted covers having a cross-extensible strip disposed peripherally on the cover to render the cover resistant to slipping off the covered article.

BACKGROUND OF THE INVENTION

Sheets of fabric are often used to cover an underlying article to protect the article from adverse effects of environmental exposure and/or wear during use. Tarps protecting vehicles or equipment, such as barbecue grills, are examples of the former and upholstery seat covers, bed sheets and mattress pads are examples of the latter. Often the covers-have an aesthetic as well as functional purpose. An age old problem with such covers has been preventing the cover from partially or completely coming off the article during use while attaching the cover such that it can be easily removed for cleaning, repair and/or to gain unrestricted access to the underlying article.

A traditional technique has been to utilize an elastic cord at the periphery of the sheet fabric such that when the cover is deployed on the article, the elastic is stretched peripherally and maintained under tension. With respect to bed sheets, mattress pads and furniture seat covers, it is known to use a peripherally elastic skirt at the periphery of the sheet or pad in place of or in combination with an elastic cord. Examples of such skirt technology is disclosed in US patents of Xymid, LLC, including U.S. Pat. Nos. 5,287,574; 5,247,893; 5,187,952; 5,603,132; 5,636,393; 6,199,231 and 6,272,701. Another conventional method of reducing the tendency of the cover to come off the article has been to use a high friction surface on the surface of the cover facing the article. These techniques function with a varying degree of success primarily when the covered article is not disturbed, e.g., for a tarp covering a car or boat not affected by wind, or a dust cover for furniture seldom or never used. However, when the cover is subject to motion or disturbance during use, such as a mattress cover on a bed, none of the established techniques provide fully satisfying results.

A very common product for covering mattresses for beds is a "fitted" sheet. Some styles use an elastic cord to gather the outer edge of the sheet, as mentioned above. Despite the use of very high modulus cords, i.e., strongly elastic, such sheets tend to "ride up" over the bottom edge of the mattress to expose the side of the mattress to view and also can come off enough to expose the top of the mattress during normal use. Another drawback is that the elasticity of the cords degrades with time under tension and due to thermal effects during laundering. Fitted sheets that use conventional skirts of typically up to about 6 inches in width with or without elastic cord borders sometimes have an unacceptable appearance and still are not completely successful at maintaining the sheet in place or retaining their anti-slipping performance after long time in use.

There remains a need to have a cover for an article that better resists the tendency to ride up or come off the article. It is desirable to have an article cover that retains its ability to stay in place over long time in use. There is a great need for an effective slip-resistant cover, especially for covering mattresses, which is aesthetically attractive.

SUMMARY OF THE INVENTION

Accordingly, the present invention provides a cover for an article comprising (a) a sheet of substantially non-stretchable fabric, the sheet defining a characteristic length, and (b) a strip of cross-extensible fabric having an inner edge attached to the sheet in a peripheral direction and having a substantially uniform transverse peripheral unstretched width of about 1–30% of the characteristic length of the sheet, in which the strip can stretch in a transverse peripheral direction by an incremental extension of at least about 150% of the unstretched width under a tensile force of less than about 160 g/cm of unstretched width.

DETAILED DESCRIPTION OF THE INVENTION

Figure 1:
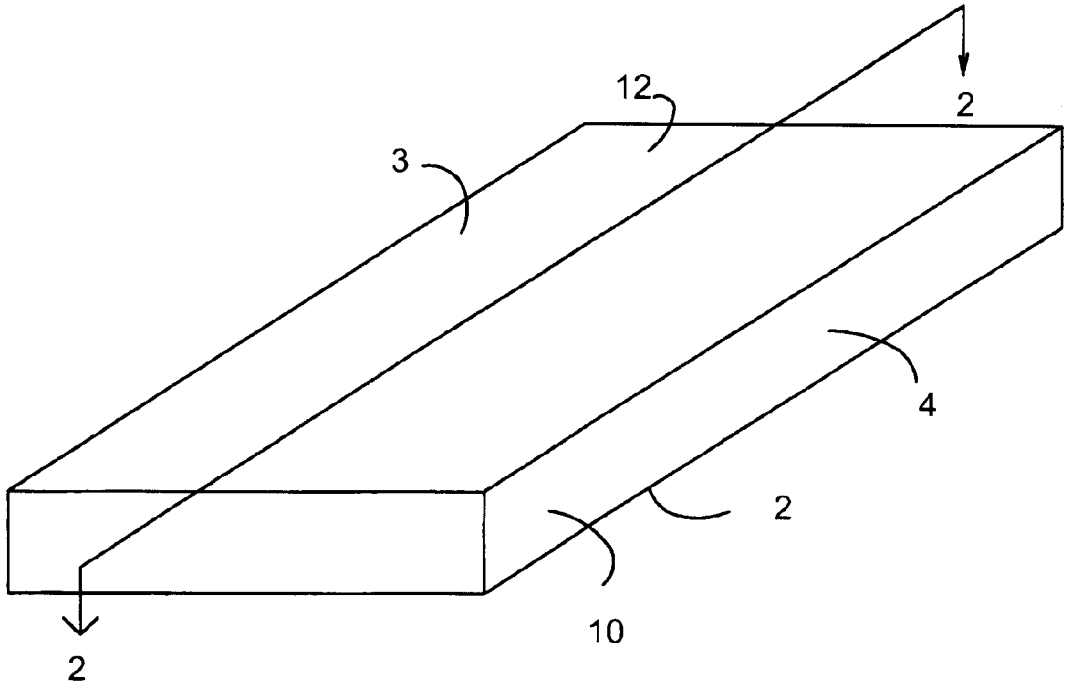
FIG. 1 is a perspective view of a mattress covered with a fitted sheet in accordance with an embodiment of this invention.
Figure 2:
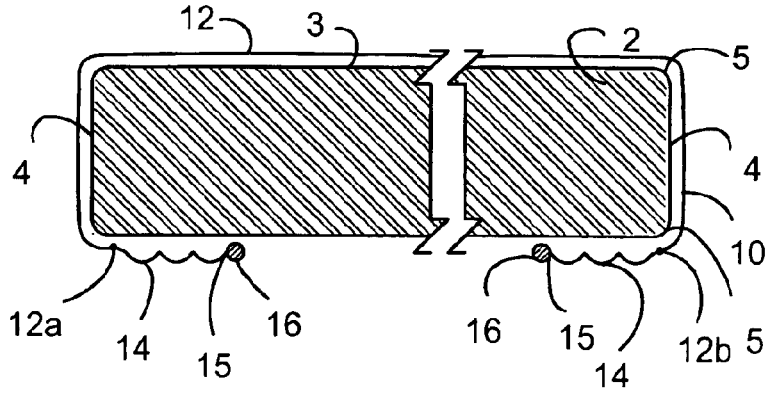
FIG. 2 is an elevation cross section view of the covered mattress of FIG. 1 taken along line 2—2.
Figure 3:
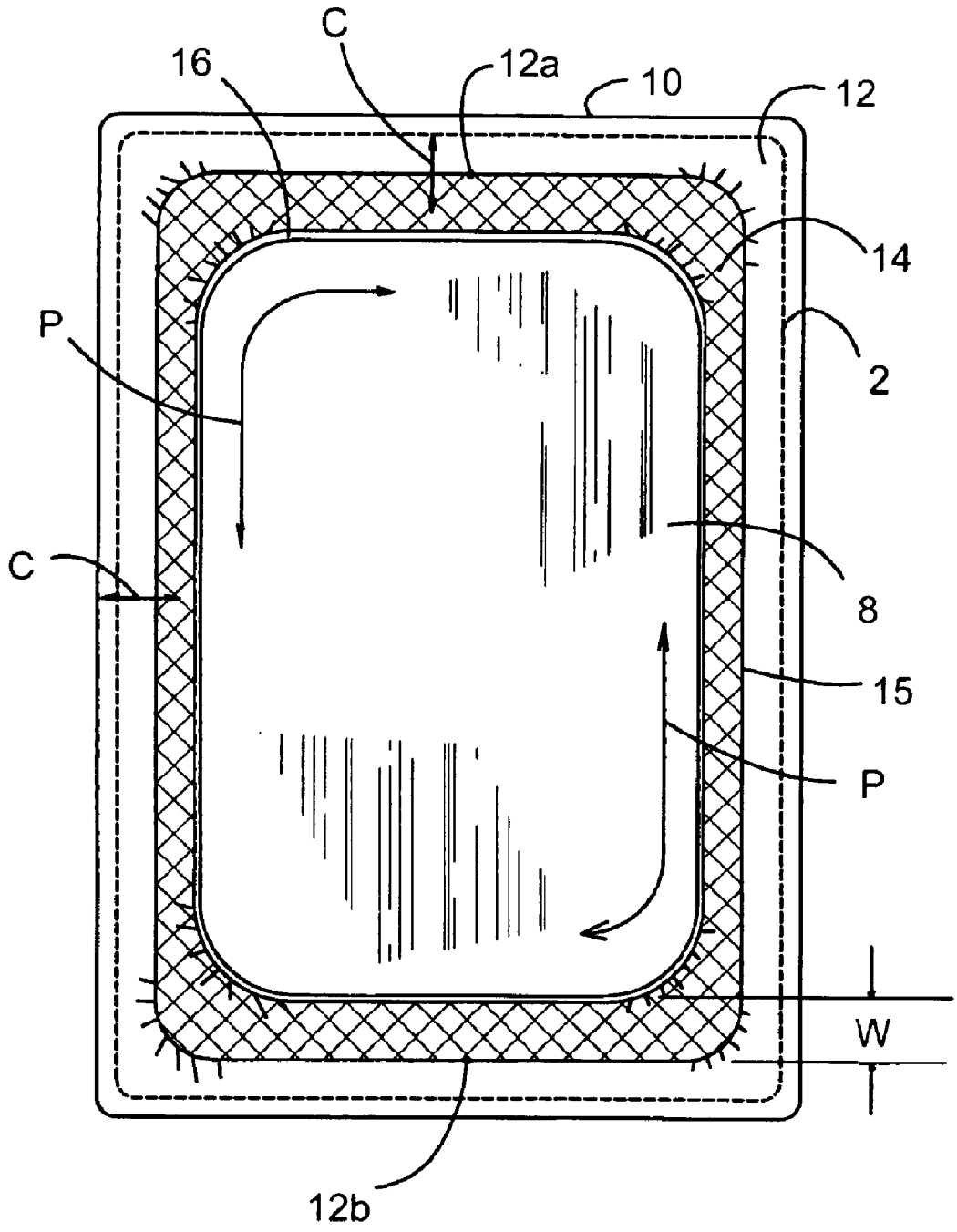
FIG. 3 is a bottom view of the covered mattress of FIG. 1.

The invention can be understood generally with reference to the elements of a fitted fabric cover illustrated in FIGS. 1–3. In the figures, like parts have the same reference numbers. The article being covered is a mattress 2, although other objects could be exemplified. Mattress 2 has an approximately rectangular cross section (FIG. 2) which is characterized by a broad, largely flat, top, horizontal sleeping surface 3 and vertical, typically smaller dimension sides 4. Corners 5 between the mattress top and sides, and between the mattress bottom 8 and sides are rounded in the illustration. Optionally, the corners can be sharp.

The mattress is covered with a fitted bedsheet 10 which has a main part, occasionally referred to herein as the "sheet" 12 formed from a substantially non-stretchable fabric material. The sheet extends over the top, sides and some of the bottom of the mattress from 12*a* to 12*b*. Adjacent to the sheet is a strip 14 of a cross-extensible fabric. The strip has an inner edge which is attached to sheet 12 circumferentially at the rim of the sheet seen in FIG. 1 as points 12*a* and 12*b*. At the outer edge of the strip 14 which also is a continuous circumferential boundary 15, is attached an elastic cord 16.

The term "substantially non-stretchable" with respect to the fabric of sheet 12 means that the sheet is largely, although not absolutely, not stretchable. That is, it will not strain to a great extension without breaking apart. This is not to preclude the sheet fabric from stretching a small amount such as would be expected from bed covering fabrics. The term "cross-extensible" is used herein to denote that fabric of the strip can stretch in a transverse peripheral direction. Cross-extensibility will be discussed in greater detail, below. The peripheral direction is parallel to the periphery of the edge of the sheet, that is, in the direction of arrows "P" in FIG. 3. The transverse peripheral direction is thus as shown by arrows "C" in this figure.

Another aspect that is useful in understanding this invention is the "characteristic length" of the sheet. The characteristic length is the longest linear dimension of the sheet. This dimension will depend somewhat on the shape of the sheet. For a circular sheet, the characteristic length is the diameter. For an oval or elliptical sheet, it is the diameter coincident with the major axis. For the rectangular sheet depicted in FIGS. 1–3, the characteristic length is the length of the sheet measured from point 12*a*, up one side 4 across the top 3 down the other side 4 to point 12*b*. The "width" of the strip is the transverse peripheral dimension W (FIG. 3). The width of the strip is substantially uniform. This is not readily apparent from the drawings which are not drawn to scale. By "substantially" uniform is meant that the actual width may deviate from perfectly uniform by a slight degree in view that the material being measured is a cross-extensible fabric. Such material is normally difficult to control to very precise dimensions. Preferably, the width of the strip may be characterized as narrow. That is, the width is much less than the characteristic length of the sheet. While the upper bound of the width is not critical, it is contemplated that a minimum width of about 0.5 inch (13 mm) is recommended to allow the strip to perform its slip-resistant function as will be explained. Subject to the minimum width dimension just mentioned, the preferable width dimension in a tension-free state, i.e., when relaxed, is about 1–10% of the characteristic length.

It is important that the strip has a cross-extensible stretch characteristic. This means that the strip can extend to a large deformation with very little tensile force applied. The ability of the cover to retain its position on the article is thought to be largely attributable to this characteristic of the strip. Preferably the cross-extensible strip can stretch in a transverse peripheral direction by an incremental extension of at least about 150% of the unstretched, (i.e., tension free) width when tensioned by a force of less than about 160 g/cm of the width. That is, the width under tension of 160 g/cm of width is at least 2.5 times the unstretched width. More preferably, the strip should stretch to an incremental extension of at least 200%.

Although the strip is able to stretch in the transverse peripheral direction to great extent under low tensile load, it is not necessarily elastic. That is, it is not critical that the strip can return substantially completely to the unstretched transverse peripheral dimension when a tensile load is removed. Elasticity in the transverse peripheral direction can adversely promote the tendency of the cover to pull off the article unless the strip exhibits a strong elasticity in the peripheral direction. Strong elasticity occurs if the strip can stretch to at least about 50% and exhibits a contraction force of at least about 0.3 N (300 g-force) at 50% extension. In a preferred embodiment, the strip is substantially inelastic in the peripheral direction.

The strip is preferably an open fabric. That is, open area between yarns or other structural components of the fabric, sometimes referred to as porosity, is a large percentage of the overall fabric area. The fabric can be woven, non-woven or knitted construction. Knitted fabric is much preferred because the knit-forming loops usually can easily separate to a large extent with little tension applied. Netting or mesh is also preferred. The open aria is generally at least about 20%, and preferably at least about 50%. Especially effective are net-like strips stitched, knit or woven with bare elastic yarns. A strip of perforated elastomeric film having intermittent parallel slits is also contemplated to be useful. It is not critical that the strip possesses a high coefficient of friction between itself and the article being covered to resist slipping. Nevertheless, it is possible and beneficial to utilize a strip that does have a high coefficient of friction.

Figure 7A:
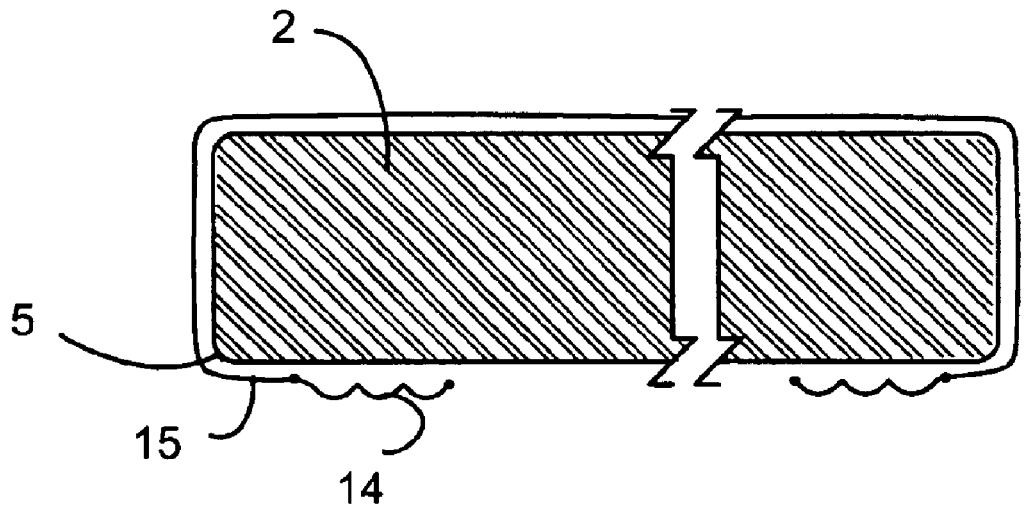
FIG. 7*a* is an elevation cross section view of a mattress covered with an embodiment of the present invention as deployed prior to activity tending to remove the cover.
Figure 7B:
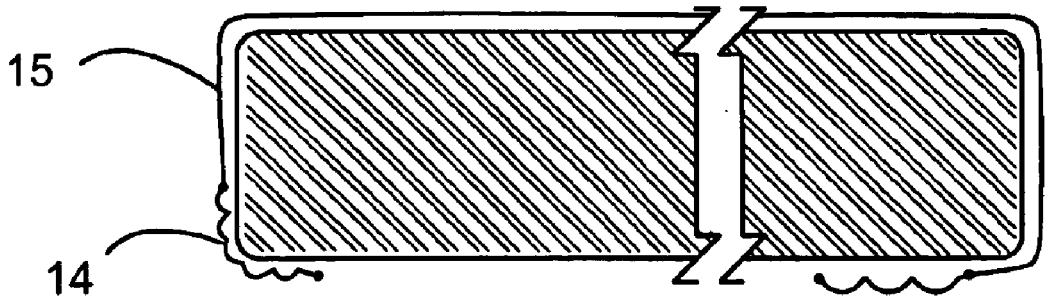
FIG. 7*b* is an elevation cross section view of the mattress covered with an embodiment of the present invention of FIG. 7*a* after activity on the mattress tending to remove the cover has occurred.
Figure 8:
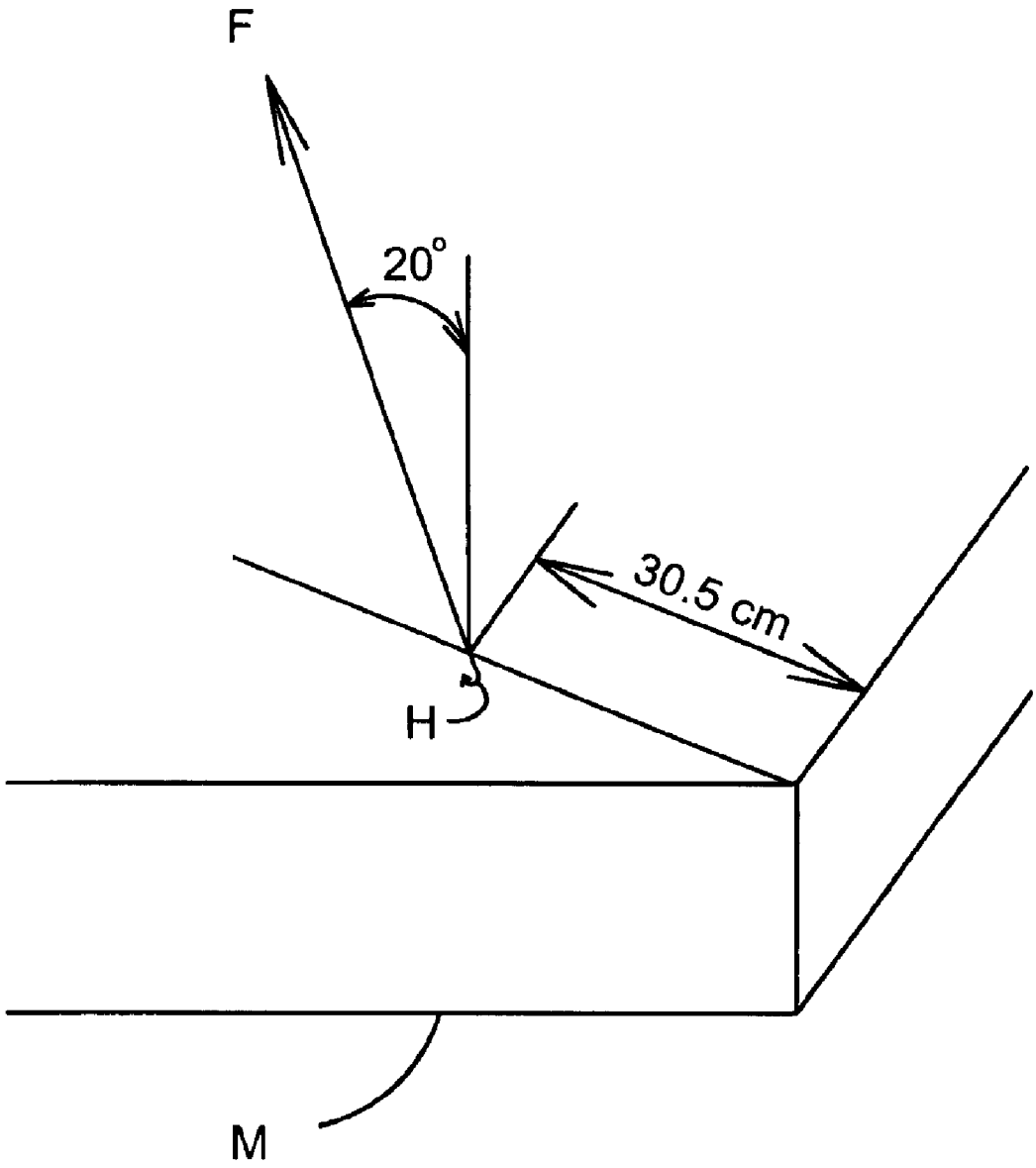
FIG. 8 is a perspective view of a mattress illustrating placement of a cover slip resistance testing apparatus.

To use the novel slip resistant cover, the cover is placed over the article such that the cross-extensible strip is positioned beyond an edge of the article. For example, in FIG. 7*a*, the strip 14 is located under the mattress and beyond bottom corners 5 of the mattress 2. The sheet 15 thus extends along the sides, around the bottom corners and under the mattress. When the article or cover moves in a way tending to pull the cover off of the article due to an activity or external force, the cross-extensible strip stretches in the transverse peripheral direction. The deformation is large because the strain-to-tensile stress characteristic of the fabric is very high. Also, the open areas between the strip fabric structural elements expand. The motion tends to pull the substantially non-stretchable sheet to ride up from below the mattress and up the side. However, the strip is drawn around the bottom corner as seen in FIG. 7*b* and the structural elements snag the edge of the article and thereby hold the attached sheet part of the cover from riding up farther. It should be further noted that a cover optionally can be initially deployed with the strip extended around corners of the article to be covered such that the corner snags the strip. Motion or applied force will not normally cause the snagged strip to release from the corner and the sheet will remain substantially in place. Thus it is not critical to deploy the cover with the strip completely positioned beyond the corner of the covered article.

To resist or prevent cover removal, the strip should be initially positioned beyond the bottom corner of the article, for example, as seen in FIG. 3. This positioning of the strip can be facilitated by placing the sheet in transverse peripheral tension, especially in the area near the edge which causes the cover to pull under the article. The transverse peripheral tension can be imparted by providing a peripherally elastic element of such length that the element is stretched when the cover is deployed. The elastic element should have a strong elasticity in the peripheral direction. The strip may itself be peripherally elastic or the peripherally elastic element can be extrinsic to the strip. For example as mentioned, the peripherally elastic element can be an elastic cord. If the strip is intrinsically peripherally elastic then a supplemental elastic cord is optional and may be excluded from the structure. If the strip is not suitably peripherally elastic, a supplemental elastic element should be provided. Preferably, either the strip should be peripherally elastic or at least one elastic cord should be utilized in the novel cover.

A wide variety of configurations that utilize many combinations of elastic cord and strip attachment are thus contemplated. These configurations are illustrated schematically in FIGS. 4–6 and are explained as follows. These figures illustrate a cross section of a cover for a mattress deployed similar to the cover in FIG. 2, however, the mattress is not shown for clarity.

A wide variety of configurations that utilize many combinations of elastic cord and strip attachment are thus contemplated. These configurations are illustrated schematically in FIGS. 4–9 and are explained as follows. These figures illustrate a cross section of a cover for a mattress deployed similar to the cover in FIG. 2, however, the mattress is not shown for clarity.

Figure 4:
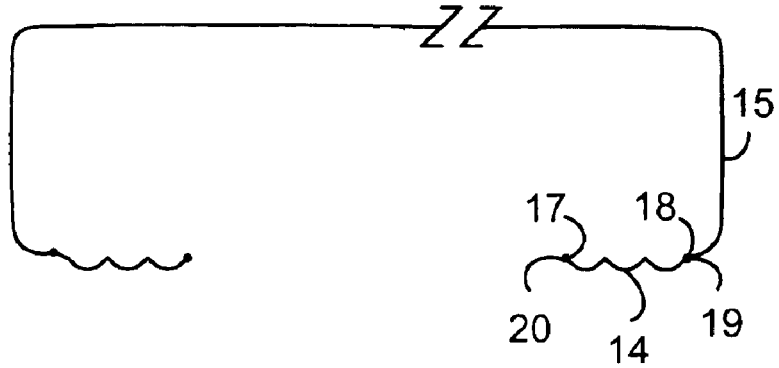
FIG. 4 is an elevation cross section view of a cover for a mattress according to another embodiment of this invention.

FIG. 4 shows an embodiment in which cross-extensible strip 14 is attached at its inner edge 18 by a seam 19 to the periphery of sheet 15. The outer edge 17 of the strip is finished 20 in a conventional matter, for example, by a hem. No added elastic cord is present in this embodiment.

Figure 5:
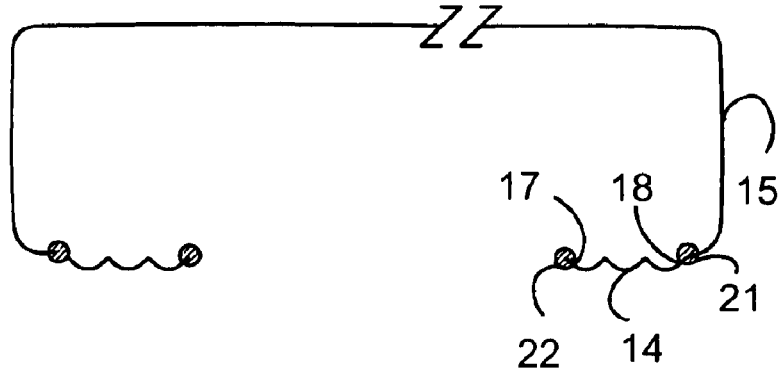
FIG. 5 is an elevation cross section view of a cover for a mattress according to another embodiment of this invention.

FIG. 5 shows an embodiment in which the strip 14 is attached at its inner edge 18 to the periphery of sheet 15 and in which an added elastic cord 21 is attached along the junction between the sheet and the strip. A second elastic cord 22 is attached at the outer edge 17 of the strip. The presence of two added elastic cords can provide greater peripheral direction elasticity which can increase the resistance of the cover to ride up or come off of the covered article. While the illustrated examples depict embodiments in which elastic cords are positioned at the edges of the strip, it should be understood that one or more elastic cords, if present, can be positioned in the strip intermediate the inner and outer edges.

Figure 6:
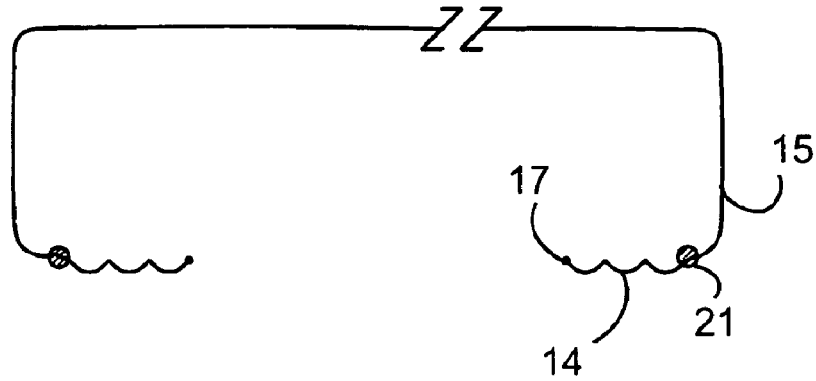
FIG. 6 is an elevation cross section view of a cover for a mattress according to another embodiment of this invention.

FIG. 6 shows an embodiment in which the strip 14 has a finished outer edge 17 and there is a single elastic cord 21 position along the junction between the strip inner edge and the sheet 15.

In a preferred embodiment, the inner edge of the strip is attached to the sheet part of the cover at a distance from the periphery of the sheet. This allows the strip to be partially or entirely concealed from view outside the cover by the sheet. Thus the superior slip resistant performance of the cover can be obtained with excellent aesthetic appearance of the cover when deployed. The strip is hidden from view from outside the cover by the tail of the sheet. The tail extends around the perimeter of the sheet and in a transverse peripheral direction from the point of attachment of the strip to the sheet periphery. In a particularly preferred embodiment, the outer edge of the strip has an elastic cord and the sheet periphery has a finished end 28. The tail can be tucked between the mattress above and the bed foundation, e.g., spring unit or bed frame, below. This permits a bed sheet to be made up in a conventional manner. Optionally, the tail can be left to hang vertically downward along and below the sides of the mattress. The strip serves to retain the sheet in place despite the appearance that the sheet is not tucked under the mattress. This feature advantageously provides an aesthetic appearance that has not heretofore been available as for example in slip resistant bed spreads.

In another "hidden strip" embodiment similar to that just described, the periphery of the sheet is equipped with an added elastic cord. In yet another "hidden strip" embodiment the strip is similar to the one just described except that the strip also has an added elastic cord that is positioned at the outer edge. These and other variations of the invention are contemplated to provide the designer with the ability to tailor the gripping power of the cover to meet the needs of a diverse range of article-covering utilities in addition to mattress sheet and pads, such as, cars, boats, barbecue grills, items of apparel, e.g., hats, decorative seat covers, toilet tank and toilet seat covers, cushion covers, outdoor mechanical equipment, e.g., generators, air conditioners, outboard motors, lawn and patio furniture, and the like.

EXAMPLES

This invention is now illustrated by examples of certain representative embodiments thereof, wherein all parts, proportions and percentages are by weight unless otherwise indicated. All units of weight and measure not originally obtained in SI units have been converted to SI units. The entire disclosures of U.S. patents named in the following examples are hereby incorporated by reference herein.

Example 1

A conventional "queen-size" woven cotton bed sheet having an integral 38 cm (15 inch) wide woven cotton skirt sewn to its perimeter was used as the sheet for the following tests.

A cross-extensible strip was made of a two-bar stitch-bonded nonwoven of a carded web consolidated with a spray of soft adhesive. The web was stitched with 77 dtex/34 filament textured polyester in the backbar and 77 dtex Lycra® elastic filament air/wrapped with a 44 dtex textured nylon filament in the front bar. Both bars were stitched at 14 gauge, 3.54 counts per cm (9 CPI). The backbar had a stitch pattern of (1-0,1-2). The front bar pattern was an extensible (1-0, 1-0, 1-2,1-2) ripple stitch adapted to allow the fabric to stretch by a factor of 3–4 times in the transverse peripheral direction. An elastic cord was formed by tripling the number of single-end yarn in the front bar for 12 rows. The total dtex of elastic yarn in each row was 231. This created a 10 cm wide strip with a 1.9 cm wide elastic cord on the edge. The cross-extensible strip was sewn to the side of the skirt to form a structure as seen in FIG. 2. The strip was found to stretch in the transverse peripheral direction by 150% with an applied force of about 90 g/cm of strip width.

The modified sheet was placed on a queen size mattress M (FIG. 8) of 30.5 cm (12 inches) side height and the sheet was pulled under the mattress to fit snuggly. A spring-operable, so-called "fish scale" meter was attached to the top of the mattress with a hook H at a point 30.5 cm (12 inches) from a corner in a direction toward the center of the sheet and was oriented in direction of arrow F at an angle of 20 degrees from vertical toward the sheet center. The fish scale meter was pulled with an increasing force starting from zero. The force necessary to pull the strip and cord from under the mattress and around the lower mattress corner was observed as the "pull-off" force. Pulling was continued and the force necessary to cause the edge of the cover to slide up along the vertical side of the mattress was also observed as the "slide-up" force. The experiment was repeated several times and the average of pull-off and slide-up forces for the trials was calculated.

Example 2

The procedure of Example 1 was repeated except that the inner edge of the strip was sewn inside the sheet 13.3 cm (5.25 inches) from the periphery of the sheet, i.e., the tail was 13.3 cm. The structure was that of the particularly preferred "hidden strip" embodiment described above.

Comparative Example 3

The queen size sheet used in the preceding examples was modified by extending the skirt width to a total of 48 cm (19 inches) to equal the dimension of the skirt plus strip of the operative examples. The elastic cord from Exs. 1 and 2 without the cross-extensible strip was attached on the peripheral edge of the skirt under tension. The procedure of the prior examples was repeated.

Results of the average and ranges of pull-off and slide-up forces of the examples described above are shown in Table 1, below.

TABLE I

| | Pull-Off Force | | Slide-Up Force | |
|---|---|---|---|---|
| | Average (N) | Range (N) | Average (N) | Range (N) |
| Ex. 1 | 75.6 (17 lb) | 71.2–80.1 (16–18 lb) | 35.6 (8 lb) | 35.6–40.0 (8–9 lb) |
| Ex. 2 | 80.1 (18 lb) | 71.2–89.0 (16–20 lb) | 35.6 (8 lb) | 35.6–40.0 (8–9 lb) |
| Comp. Ex. 3 | 40.0 (9 lb) | 35.6–44.8 (8–10 lb) | 13.3 (3 lb) | 13.3–17.8 (3–4 lb) |

These results show that the addition of a cross-extensible strip dramatically improved the slip resistance of the bed sheet.

Although specific forms of the invention have been selected in the preceding disclosure for illustration in specific terms for the purpose of describing these forms of the invention fully and amply for one of average skill in the pertinent art, it should be understood that various substitutions and modifications which bring about substantially equivalent or superior results and/or performance are deemed to be within the scope and spirit of the following claims.

What is claimed is:

1. A cover for an article comprising (a) a sheet of substantially non-stretchable fabric, the sheet defining a characteristic length, and (b) a strip of cross-extensible fabric having an inner edge attached to the sheet in a peripheral direction and having a substantially uniform transverse peripheral unstretched width of about 1–30% of the characteristic length of the sheet, in which the strip can stretch in a transverse peripheral direction by an incremental extension of at least about 150% of the unstretched width under a tensile force of less than about 160 g/cm of unstretched width.

2. The cover of claim 1 in which the strip is elastic in the peripheral direction such that the strip can stretch to at least about 50% and exhibits a contraction force of at least about 0.3 N at 50% extension.

3. The cover of claim 1 in which the strip is substantially inelastic in the peripheral direction.

4. The cover of claim 1 which further comprises an elastic cord longitudinally oriented in a peripheral direction in contact with the strip and having an elastic characteristic such that the cord can stretch to at least about 50% and exhibits a contraction force of at least about 0.3 N at 50% extension.

5. The cover of claim 4 in which the elastic cord is positioned at the inner edge of the strip.

6. The cover of claim 5 in which the strip has an outer edge opposite the inner edge and further comprises an elastic cord positioned at the outer edge.

7. The cover of claim 4 in which the strip has an outer edge opposite the inner edge and the elastic cord is positioned at the outer edge.

8. The cover of claim 1 in which the inner edge of the strip is adjacent the periphery of the sheet.

9. The cover of claim 8 which further comprises an elastic cord longitudinally oriented in a peripheral direction in contact with the strip and having an elastic characteristic such that the cord can stretch to at least about 50% and exhibits a contraction force of at least about 0.3 N at 50% extension.

10. The cover of claim 9 in which the elastic cord is positioned at the inner edge of the strip.

11. The cover of claim 9 in which the strip has an outer edge opposite the inner edge and the elastic cord is positioned at the outer edge.

12. The cover of claim 1 in which the inner edge of the strip is offset from the periphery of the sheet.

13. The cover of claim 12 which further comprises an elastic cord longitudinally oriented in a peripheral direction in contact with the strip and having an elastic characteristic such that the cord can stretch to at least about 50% and exhibits a contraction force of at least about 0.3 N at 50% extension.

14. The cover of claim 13 in which the elastic cord is positioned at the inner edge of the strip.

15. The cover of claim 13 in which the strip has an outer edge opposite the inner edge and the elastic cord is positioned at the outer edge.

16. The cover of claim 12 which further comprises an elastic cord longitudinally oriented adjacent the periphery of the sheet and having an elastic characteristic such that the cord can stretch to at least about 50% and exhibits a contraction force of at least about 0.3 N at 50% extension.

17. The cover of claim 16 which further comprises an elastic cord longitudinally oriented in a peripheral direction in contact with the strip and having an characteristic such that the cord can stretch to at least about 50% and exhibits a contraction force of at least about 0.3 N at 50% extension.

18. The cover of claim 12 in which the inner edge of the strip is offset from the periphery of the sheet by a distance greater than the width.

19. The cover of claim 1 in which the strip is a net having an open area of at least about 20%.

20. The cover of claim 1 in which the cover is adapted to cover a mattress.

21. The cover of claim 1 in which the strip is a perforated film having an open area of at least about 20%.

* * * * *